US005269287A

United States Patent [19]

Krieger

[11] Patent Number: 5,269,287

[45] Date of Patent: Dec. 14, 1993

[54] FURNACE GRATE

[75] Inventor: Friedrich Krieger, Würzburg, Fed. Rep. of Germany

[73] Assignee: Noell K&K Abfalltechnik GmbH, Neuss, Fed. Rep. of Germany

[21] Appl. No.: 837,023

[22] Filed: Feb. 14, 1992

[30] Foreign Application Priority Data

Feb. 18, 1991 [DE] Fed. Rep. of Germany ..... 4105328

[51] Int. Cl.[5] ..... F23H 7/08

[52] U.S. Cl. ..... 126/175; 126/174; 126/169; 110/251; 414/156

[58] Field of Search ..... 126/174, 175, 169, 152 B; 110/281, 282, 284; 414/150, 156; 198/750, 773, 952

[56] References Cited

U.S. PATENT DOCUMENTS

| | | | |
|---|---|---|---|
| 3,373,618 | 3/1968 | Miller | 110/267 X |
| 4,018,168 | 4/1977 | Andreoli et al. | 126/174 X |
| 4,102,449 | 7/1978 | Shufran | 414/156 X |
| 4,320,710 | 3/1982 | Steiner | 110/255 X |
| 4,895,084 | 1/1990 | Kroon et al. | 110/281 X |
| 4,901,653 | 2/1990 | Baltzinger | 414/156 X |

FOREIGN PATENT DOCUMENTS

| | | |
|---|---|---|
| 2446724 | 10/1975 | Fed. Rep. of Germany . |
| 3007678 | 9/1980 | Fed. Rep. of Germany . |

*Primary Examiner*—Larry Jones

*Attorney, Agent, or Firm*—Cohen, Pontani, Lieberman, Pavane

[57] ABSTRACT

A furnace grate for use in a combustion furnace includes rows of grate bars positioned one behind the other, moveable and stationary grate bar supports, side plates, drive shafts and fluid cylinders. The grate bars are seated on the grate bar supports within the furnace while the fluid cylinders are positioned outside the furnace wall.

9 Claims, 6 Drawing Sheets

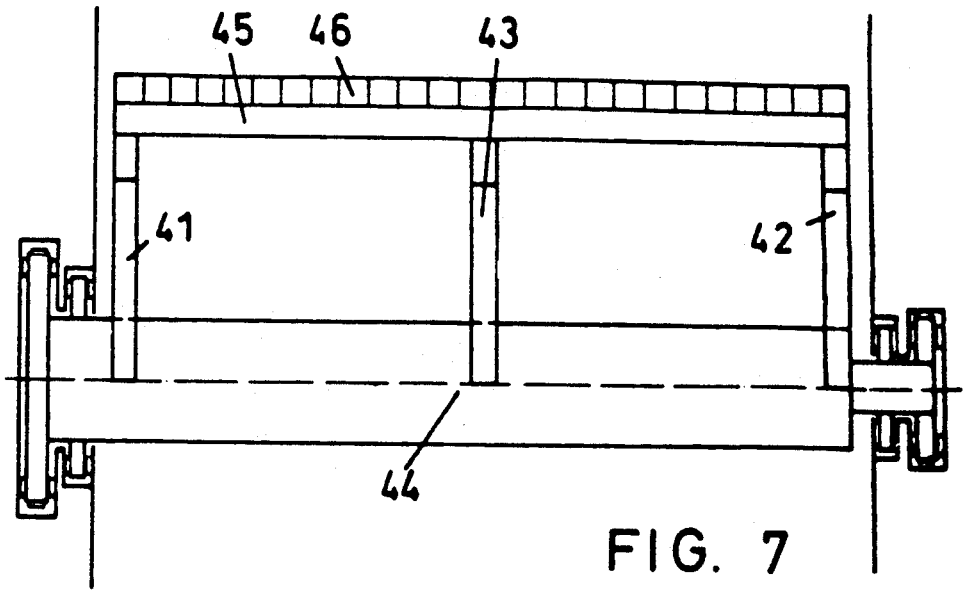
FIG. 7
FIG. 6
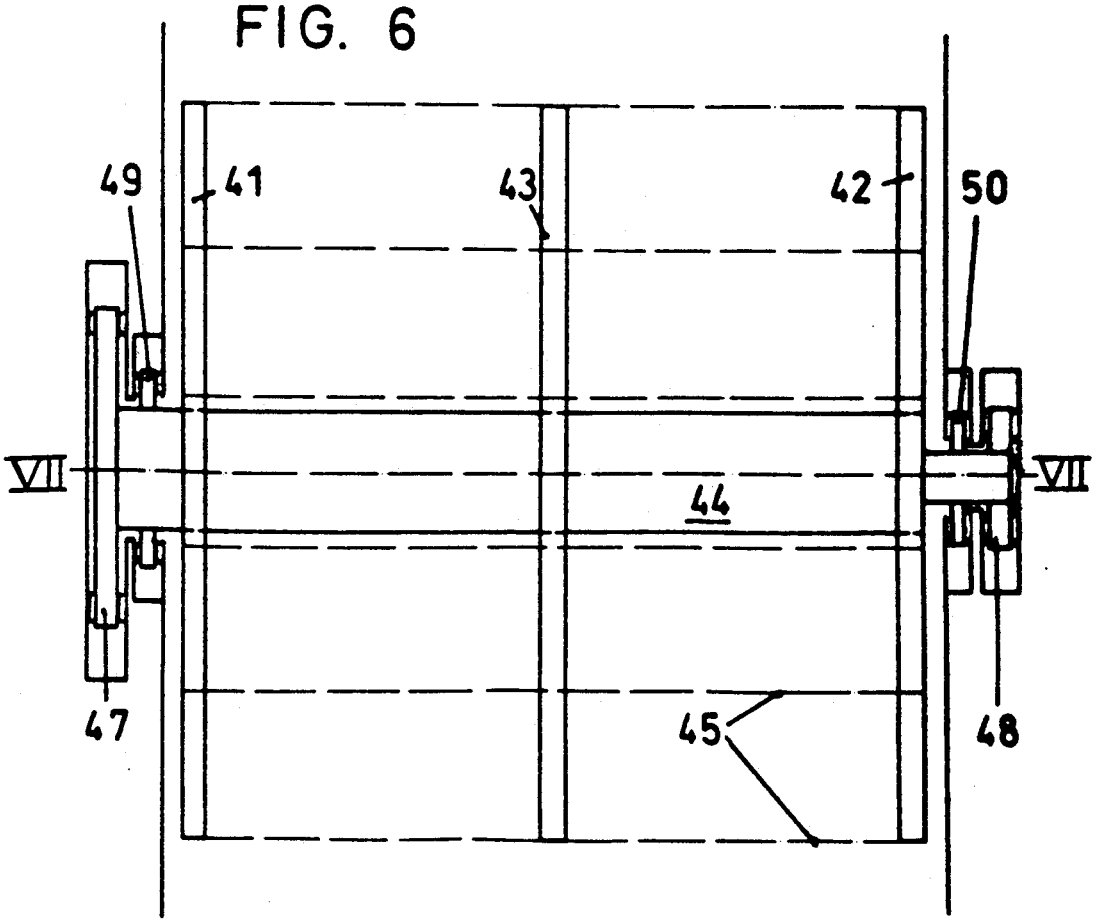

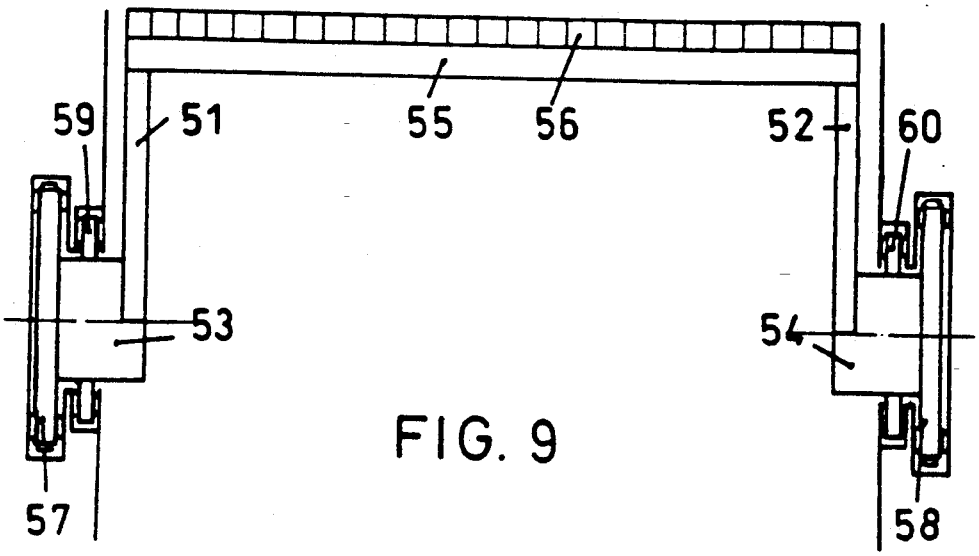
FIG. 9
FIG. 8
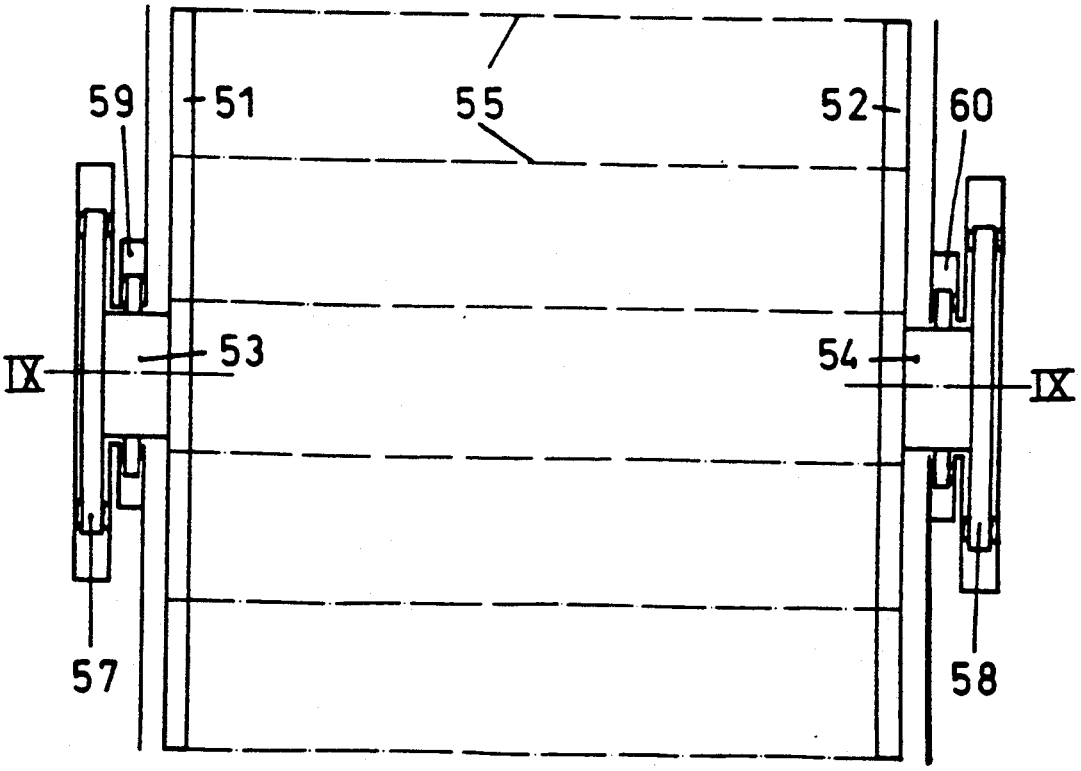

FURNACE GRATE

FIELD OF THE INVENTION

The present invention relates to a furnace grate for a combustion furnace, and particularly to a grate for a waste incinerator having overlapping rows of grate bars.

BACKGROUND OF THE INVENTION

A furnace grate in an incinerator furnace, typically consists of horizontally or obliquely arranged overlapping rows of grate bars. These rows of grate bars are placed one behind the other, in the same manner that roofing shingles overlap one another. Every second row of grate bars has a drive associated with it for moving the material to be burned and for improving the raking action. The movement of the rows of grate bars is accomplished by connecting several rows of grate bars and by actuating the rows of grate bars with a single drive. A grate bar of the above-mentioned type is disclosed in German Patent 24 46 724, in which a cylinder, positioned behind a carriage carrying a plurality of moveable rows of grate bars seated on a grate bar support, moves the carriage in the feed direction.

The drives and moving parts of the furnace grate are positioned underneath the grate and within the undergrate blast or air region. The above arrangement for moving parts and drives is especially problematic since, within the undergrate air region, they are exposed to high temperatures and the likehood exists that burning material will fall between the grate bars so as to render the drives and moving parts susceptible to failure. Because the devices and moving parts are located beneath the grate and within the undergrate air region, they are inaccessible during operation of the furnace, and, therefore, cannot be checked or serviced so as to render these devices and moving parts undependable.

German Patent 30 07 678, discloses an arrangement wherein the grate bar supports are located on torsion shafts which extend outside of the undergrate blast region, so that the essential parts of the drive, such as the stroke cylinder, swing rod and linear guides are positioned outside the walls of the furnace. However, the numerous torsion shafts, and the numerous rotary, swivel and linear guides lying outside of the furnace walls, as well as the grate bar joints positioned within the furnace present a problem. A comparison of the prior art cited above shows that several hundred moveable locations per grate are present in the drive chain.

SUMMARY OF THE INVENTION

An object of the present invention is to provide a furnace grate for a combustion furnace in which the number of slide locations or moving parts are minimized and are positioned outside the undergrate blast region.

Thus, the present invention relates to a furnace grate for use in a combustion furnace, in particular a furnace for burning garbage, in which overlapping rows of grate bars are positioned one behind the other. These grate bars are seated on grate bar supports, every second one of which is mounted on a moveable carriage while the remaining grate bar supports are fixed in space. Moreover, the carriage has a movement drive located outside the undergrate blast or air region of the furnace grate. The above-mentioned drive can be, for example, a hydraulic cylinder which is coupled to a shaft which, in turn, moves the carriage while the axle extends through a slot seal in the furnace wall. Further, it is important to note that all drive elements operate along the feed direction of the grate bar so as to obviate the need for swivel bearings. Such a configuration outside of the undergrate blast region is particularly advantageous in as much as drive members are substantially protected from dirt and can be checked and serviced outside the furnace chamber.

The only critical element is a slot seal, which consists of a disk which is sealed off on the shaft and, in turn, lies between two side guides within a housing on the wall of the furnace. These side guides can be configured as flat seals for the disk.

Flat seals have proven satisfactory and can be made so as not to be susceptible to failure. For additional sealing, the space between the outer flat seals and around the disk, can be protected by sealing air or an air barrier. In this manner, dust or the like from the region below the furnace grate is prevented from penetrating into the slot seal and from passing outwards.

In one embodiment of the present invention, the shaft is mounted in a path guide, such as a roller path guide, outside the undergrate blast region. The roller path guide can be covered in accordance with the present invention by using a steel-tape blind or cover. Such roller path guides and steel tape blinds have proven satisfactory in rough operation and assure dependable guidance of the carriage shaft.

Through experience, it is known that grate bars become worn on both the upper and lower surfaces after a lengthy operation of the furnace. A non-linear feed movement of the grate bars can occur as a result of having a constant or fixed drive point. However, the non-linear movement can be compensated by adjusting the height thereof with due consideration of the angular position of the roller path guide. This adjustment in height can be achieved by placing shims below the bearing pedestal of the guide. Moreover, an adjustment to the height of the guide can be done prior to operating the furnace grate by selecting an average direction of feed corresponding to the expected duration of operation of the furnace and the expected resultant wear on the grate bars.

Several methods for supporting the torque generated by the drive and acting on the carriage are provided in the present invention. A non-driven shaft, extending parallel to the drive shaft, can be provided which connects both sides of the carriage and is disposed on one side, outside of the undergrate blast region. In addition, a larger torsionally rigid driven shaft can be used to connect both sides of the carriage, if there is sufficient space. The drive shaft is connected to at least one side of the carriage, outside the undergrate blast region with a wedge plate which is guided by double roller bearings or plain bearings which grip around the path guides on all sides.

In a further embodiment, short carriage shafts or stub shafts are connected to the side plates of the carriage without the drive shaft connecting both carriage sides. This structural configuration is suitable only if only slight torsional forces are present. The side plates of the carriage are then merely connected to each other by the grate bar supports.

In the system of the present invention, the number of points of wear has been reduced when compared with that of the prior art, to merely sixteen or twenty-four elements, depending on the nature of the torque support used for the same length of furnace grate.

The improvement is due to the fact that joints that require servicing are intentionally eliminated from the region proximate to the grate bars. The moveable grate bars are placed on grate bar supports and are moved along only by the grate bar supports.

BRIEF DESCRIPTION OF THE DRAWINGS

Several embodiments of the present invention will be described below with reference to the drawings, in which:

FIG. 6 is a top view of yet another embodiment of the present invention;

FIG. 7 is a sectional view through the carriage along section VII—VII of FIG. 6;

FIG. 8 is a top view of still another moveable carriage of a furnace grate in accordance with the present invention; and FIG. 9 is a sectional view along line IX—IX through the carriage of FIG. 8.

DESCRIPTION OF THE PRESENTLY PREFERRED EMBODIMENTS

Figure 1:
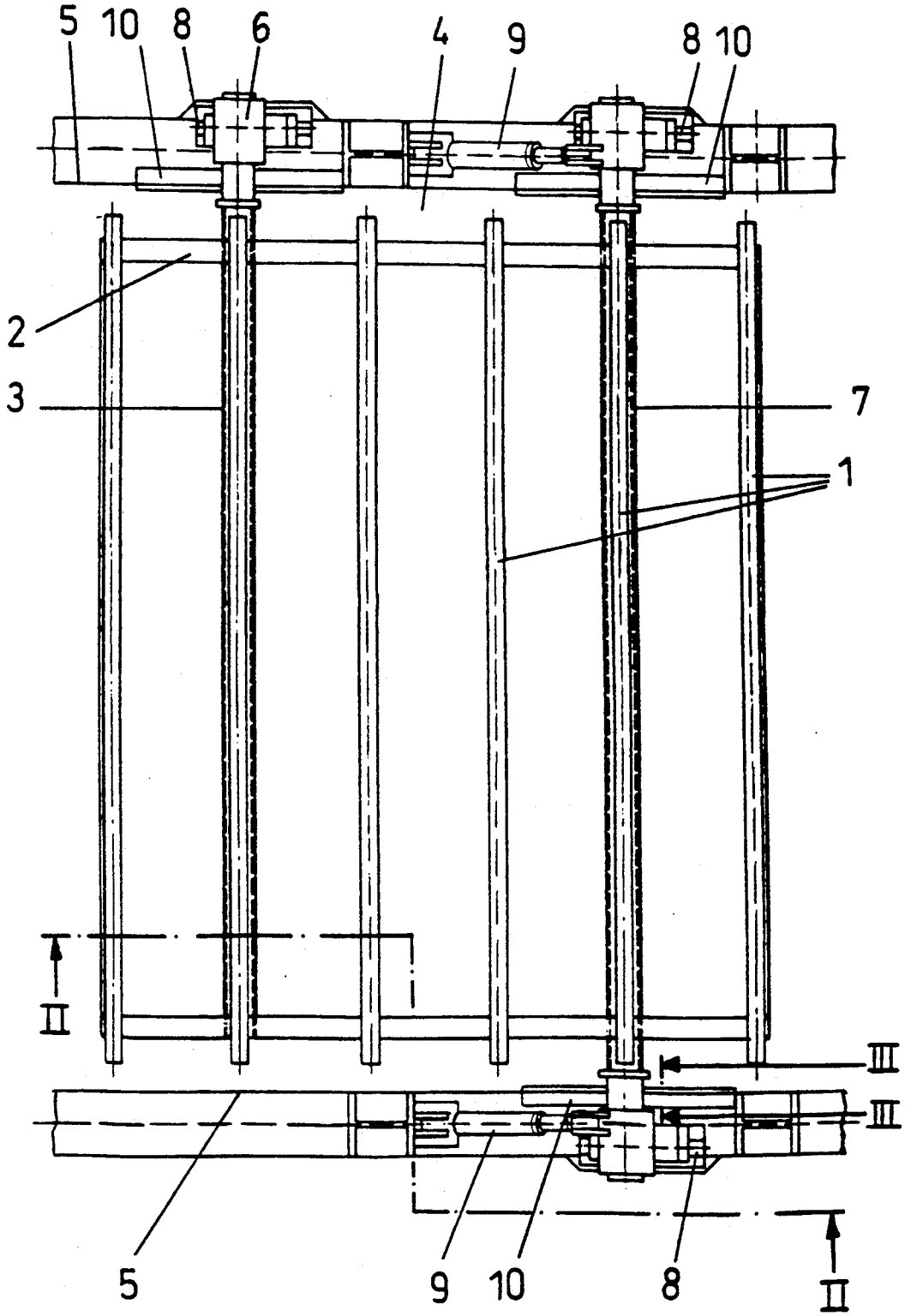
FIG. 1 is a top view of a moveable carriage of a furnace grate of the present invention.

FIG. 1 is a top view of a moveable carriage 2. The grate bars 12 (FIG. 2) rest on a moveable grate bar support 1 of the carriage 2. The carriage 2 has a non-driven shaft 3 which is held on one side in bearing box 6 outside the combustion chamber 4 and outside the furnace wall 5. Furthermore, the carriage 2 has a driven shaft 7 which is mounted on both sides of carriage 2, outside the furnace wall 5, and which is moved by cylinder 9. The openings in the furnace wall 5 through which the shafts 3 and 7 extent are sealed around each shaft by slot seals 10. The cylinders 9 and roller path guides 8, as well as grate bars 12, extend and move in the same direction of movement. It follows from the above that the slot seals 10 are also moveable in the same direction of movement.

Figure 2:
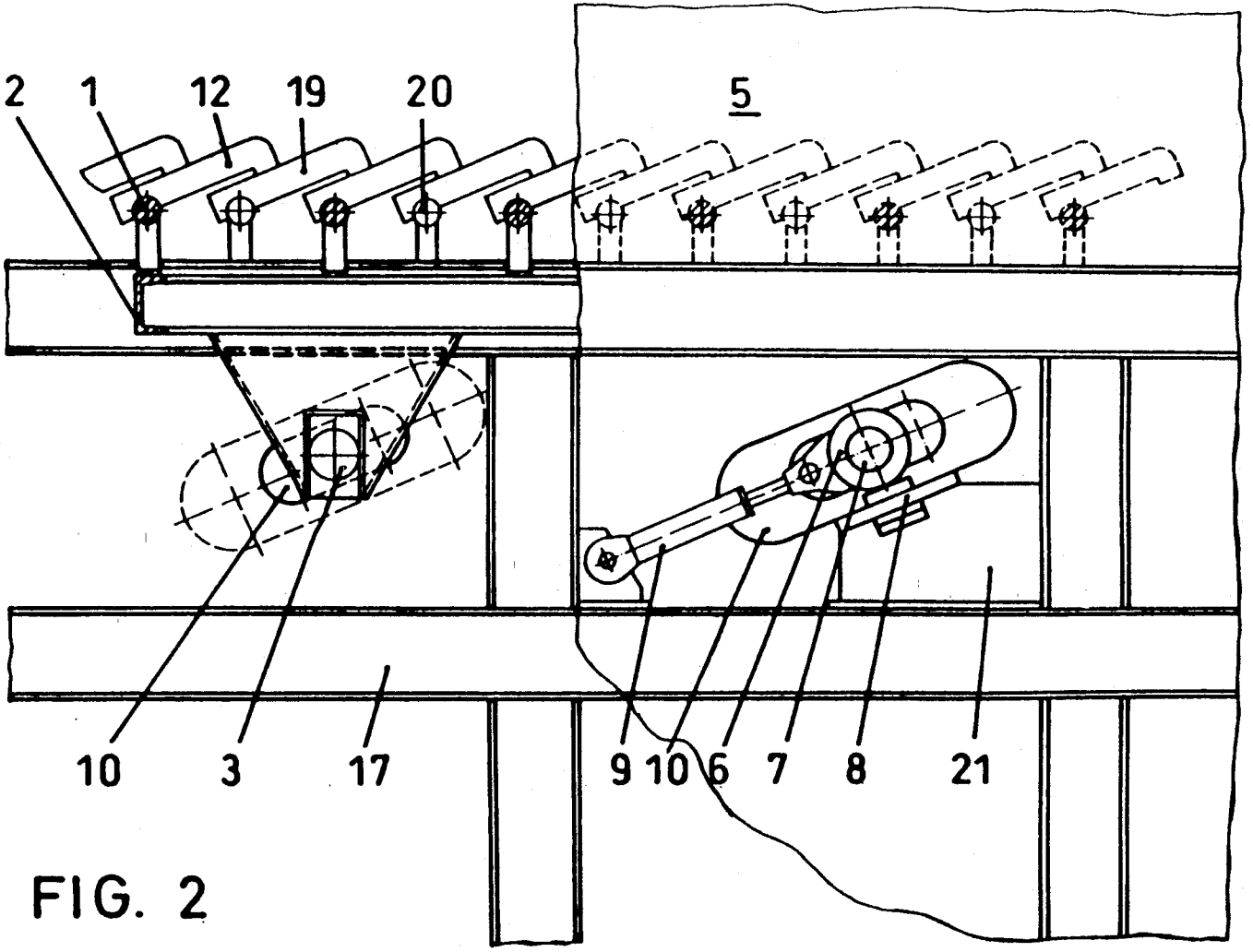
FIG. 2 is a side view of a furnace grate along section II—II in FIG. 1.

FIG. 2 illustrates the furnace structure 17 comprising of steel girders on which the furnace wall 5 which defines the combustion chamber is fastened. Grate bars 12 are arranged on carriage 2, which is driven by shaft 7 and additionally guided by shaft 3. Additional grate bars 19 are arranged on fixed grate bar supports 20 which are not mounted on carriage 2. The cylinder 9 moves the shaft 7 which rests in bearing box 6. The bearing box 6, in turn, is guided in the direction of movement of the moveable grate bars 12 by roller path guide 8, disposed on the vertically adjustable pedestal 21. Shafts 3 and 7 pass through respective slot seals 10 dispersed in the furnace wall 5.

Figure 3:
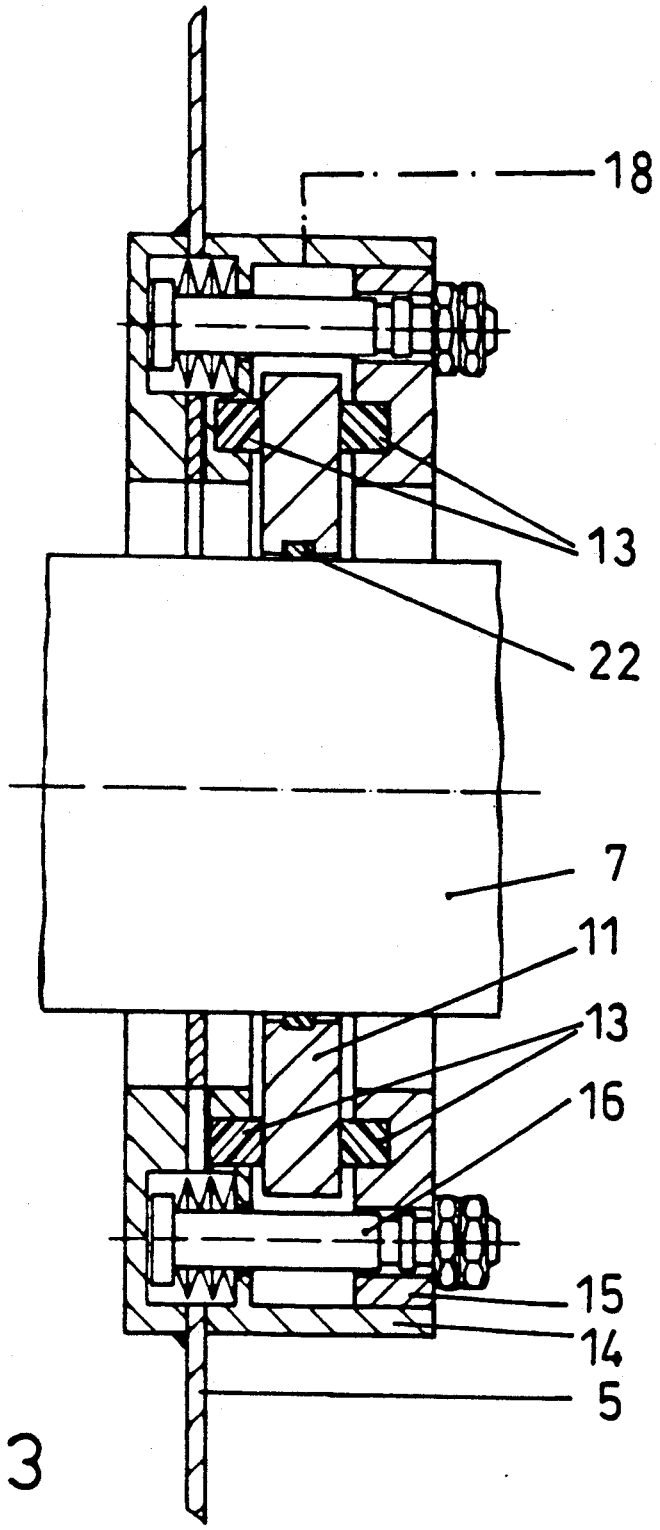
FIG. 3 is a sectional view through the slot seal along section III—III as shown in FIG. 1.

FIG. 3 illustrates the drive shaft 7 of the carriage 2 on which shaft, a moveable disk 11 of slot seal 10 is arranged in accordance with section III—III of FIG. 1. DIsk 11 is supported for longitudinal movement between flat seals 13. This labyrinth-like sealing system is surrounded by a tight housing 14 with cover 15 and is held by bolts 16. The housing has a sealing air inlet 18 for providing the sealing air to the space within housing 14 outside the flat seals 13 and disk 11. The housing 14 of the slot seal 10 is fastened to the furnace wall 5. On the loose bearing side of the carriage, the disk 11 is provided with a seal 22 for drive shaft 7 so that shaft 7 can expand thermally without exerting pressure on the flat seals 13.

Figure 4:
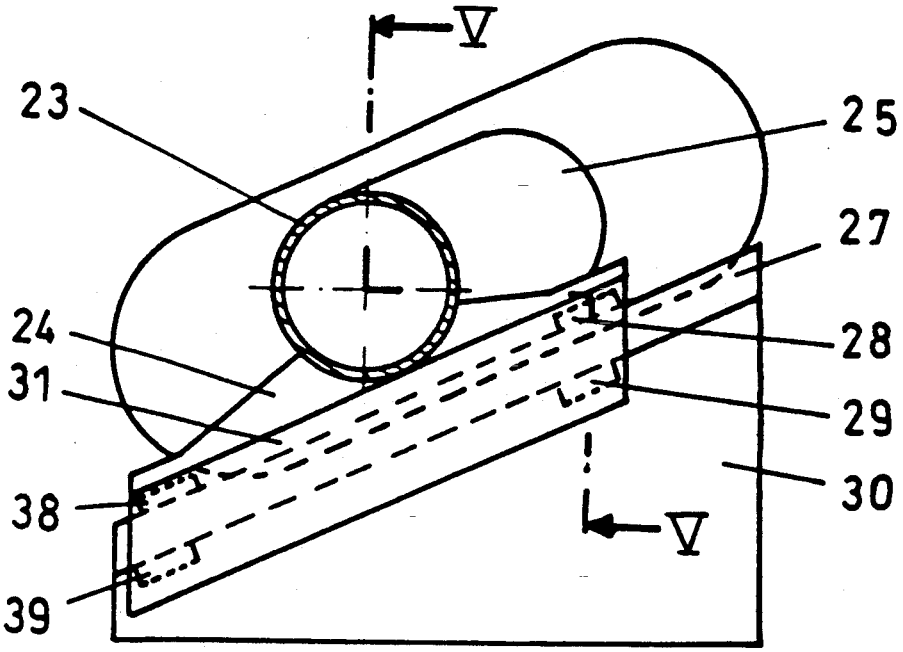
FIG. 4 is a partial sectional view of a fixed bearing side of another embodiment of the present invention.

FIG. 4 shows in a side view, a cut shaft 23 of a carriage (not shown). The shaft 23 is a torsionally rigid tube with a wedge plate 24 welded thereon. The slot seal 25 is configured in substantially the same manner as that described in reference to FIG. 3.

Bearing shield 31 is flanged onto wedge plate 24. Upper and lower roller bearings 28, 38 and 29, 39, respectively, are disposed on both wedge plate 24 and bearing shield 31. These roller bearings rest on roller path guide 27 of bearing pedestal 30. By offsetting the location of the bearings with respect to shaft 23 of the carriage, the wedge plate 24 acts as a torque support.

Figure 5:
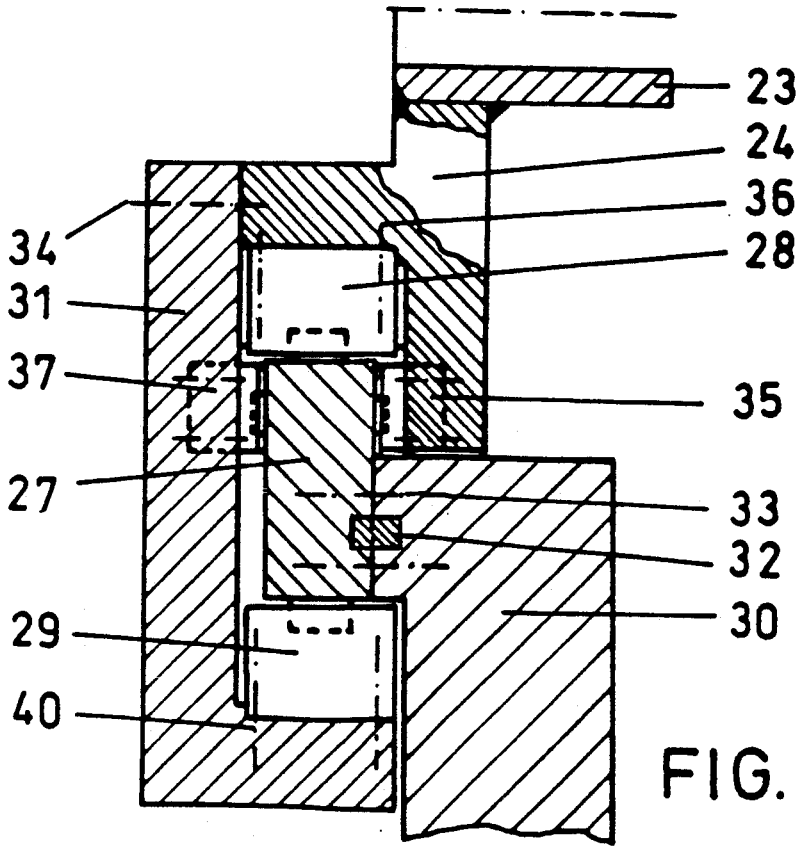
FIG. 5 is a cross-sectional view of a roller path guide along section V—V of FIG. 4.

FIG. 5 illustrates in accordance with section V—V of FIG. 4, the location of the bearings on rollerpath guide 27. The bearings are connected by bolt 33 which, in turn, is connected to the bearing pedestal 30 by centering ledge 32. Wedge plate 24 is welded to shaft 23, while in front of wedge plate 24 the bearing shield 31 is held by bolt 34. The bearing is developed as a fixed bearing. Each bearing location comprises, within the wedge plate 24, a roller bearing 28 with attachment 36 for the upper vertical guidance and a roller bearing 35 for the axial guidance; and in the bearing shield 31, a lower roller bearing 29 with attachment 40 for the lower vertical guidance and a lateral roller bearing 37 for the axial guidance.

FIG. 6 schematically illustrates a carriage of yet another embodiment of the present invention, in which side plates 41, 42 and center plate 43 are mounted on a tubular drive shaft 44.

The moveable grate bar supports 45 for the grate bars 46 rest against the plates (FIG. 7). A torsionally rigid fixed bearing 47 on one side and a loose bearing 48 on the other side permit movement of the drive shaft 44 in the path guides, in much the same manner as previously discussed in the preceding figures. Slot seals 49, 50 seal the bearings from the undergrate blast region of the furnace.

FIG. 7 is a schematic cross-sectional view along drive shaft 44 and through the carriage in accordance with FIG. 6 and shows the position of the moveable grate bar support 45 with the grate bars 46 resting thereon.

FIG. 8 schematically illustrates yet another carriage in accordance with the present invention, wherein each of the side plates 51, 52 are arranged on drive stub shafts 53, 54. The stub shafts 53, 54 extend through respective slot seals 59, 60 on the furnace wall and are held in bearings 57, 58. The stub shafts 53, 54 are mounted in a manner similar to that shown in FIG. 4. In addition, the side plates 51, 52 of the carriage are connected to each other merely by stable grate bar supports 55 on which grate bars 56 rest as more clearly shown in FIG. 9.

It should be understood that the preferred embodiments and examples described are for illustrative purposes only and are not to be construed as limiting the scope of the present invention which is properly delineated only in the appended claims.

What is claimed is:

1. A furnace, particularly a waste incinerator, comprising:

a) a combustion chamber bound by a chamber wall and comprising an undergrate blast region;

b) a carriage having two side plates and two sides and being movably mounted within said chamber for movement in a direction of feed;

c) a plurality of rows of grate bars disposed within said chamber above said undergrate blast region, said rows of grate bars being arranged transversely to the direction of feed and comprising a plurality of substantially parallel grate bars extending in the direction of feed and being arranged so as to overlap an adjacent row of grate bars, every second one of said rows of grate bars being supported on said side plates of said moveable carriage;

means mounted within said combustion chamber wall for sealing said chamber;

d) a shaft connected to said carriage and extending through said sealing means in said chamber wall; and means disposed outside said combustion chamber and being moveable in the direction of feed for moving said shaft, said carriage and said second ones of said rows of grate bars, wherein said means for moving said shaft comprises a fluid cylinder having a piston connected to said shaft and reciprocatingly moveable in the direction of feed.

2. The furnace grate of claim 1, additionally comprising at least one torque support disposed outside said chamber wall on one of the sides of said carriage.

3. The furnace grate of claim 1, wherein said shaft is composed of two stub shafts, each stub shaft being connected to one of said side plates.

4. The furnace grate of claim 1, wherein the sealing means is a moveable slot seal having an interior space and comprising two guides disposed substantially parallel with said chamber wall; and a disk sealingly mounted on said shaft and arranged for sliding movement between said guides.

5. The furnace grate of claim 4, additionally comprising means at said slot seal for admitting sealing air into said interior space thereof.

6. The furnace grate of claim 5, wherein said means for moving said shaft comprises a path guide disposed outside said chamber wall for supporting and guiding said shaft.

7. The furnace grate of claim 6, additionally comprising a steel tape covering said path guide for protecting said path guide.

8. The furnace grate of claim 6, additionally comprising means for vertically adjusting said path guide to compensate for wear of the grate bars.

9. The furnace grate of claim 6, wherein said path guide is a roller guide comprising an elongated guide member having guide sides and roller bearings mounted for guiding engagement with said guide sides of said member.

* * * * *